US008610315B2

(12) United States Patent
Ushiro

(10) Patent No.: US 8,610,315 B2
(45) Date of Patent: Dec. 17, 2013

(54) CIRCUIT AND HEATING APPARATUS THAT COMPLETELY CUTS POWER TO A SUPPLY CIRCUIT DUE TO BLOWOUT OF A FUSE ON A SINGLE SUPPLY LINE

(75) Inventor: Takahiro Ushiro, Toride (JP)

(73) Assignee: Canon Kabushiki Kaisha (JP)

( * ) Notice: Subject to any disclaimer, the term of this patent is extended or adjusted under 35 U.S.C. 154(b) by 98 days.

(21) Appl. No.: 12/182,067

(22) Filed: Jul. 29, 2008

(65) Prior Publication Data

US 2009/0034142 A1 Feb. 5, 2009

(30) Foreign Application Priority Data

Jul. 31, 2007 (JP) ..... 2007-199895

(51) Int. Cl.
*H01H 83/00* (2006.01)

(52) U.S. Cl.
USPC ..... 307/131; 399/33; 399/45; 399/69; 399/88

(58) Field of Classification Search
USPC ..... 307/131; 399/45, 69, 88, 33; 361/104
See application file for complete search history.

(56) References Cited

U.S. PATENT DOCUMENTS 2,712,103 A * 6/1955 Purifoy ..... 318/64
3,309,478 A * 3/1967 Kiesel et al. ..... 337/7
3,579,217 A * 5/1971 Casey et al. ..... 340/635
3,638,157 A * 1/1972 Kruzic ..... 337/6
3,828,289 A * 8/1974 Hickling ..... 337/5
4,044,395 A * 8/1977 Eckart ..... 361/44
4,156,884 A * 5/1979 Eckart et al. ..... 361/46
4,233,639 A * 11/1980 Klein et al. ..... 361/44
4,241,302 A * 12/1980 Benjamin ..... 318/758
4,370,692 A * 1/1983 Wellman et al. ..... 361/109
4,550,358 A * 10/1985 Crowley et al. ..... 361/42
4,587,588 A * 5/1986 Goldstein ..... 361/54
4,751,603 A * 6/1988 Kwan ..... 361/42
4,763,013 A * 8/1988 Gvoth et al. ..... 307/66
4,823,225 A * 4/1989 Foster et al. ..... 361/42
4,853,822 A * 8/1989 Kamijo ..... 361/100
5,225,874 A * 7/1993 Koh et al. ..... 399/69
5,322,971 A * 6/1994 Owen ..... 174/50
5,341,266 A * 8/1994 Grove ..... 361/45
5,347,418 A * 9/1994 Ando et al. ..... 361/104
5,424,893 A * 6/1995 Francis et al. ..... 361/45
5,481,089 A * 1/1996 Furuta ..... 219/497
5,629,825 A * 5/1997 Wallis et al. ..... 361/64
5,793,587 A * 8/1998 Boteler ..... 361/42
5,856,711 A * 1/1999 Kato et al. ..... 307/10.6
6,246,843 B1 * 6/2001 Nanataki et al. ..... 399/45
6,252,311 B1 * 6/2001 West ..... 307/29
6,292,337 B1 * 9/2001 Legatti et al. ..... 361/46

(Continued)

FOREIGN PATENT DOCUMENTS

JP 7-231659 A 8/1995

*Primary Examiner* — Jared Fureman
*Assistant Examiner* — Alfonso Perez Borroto
(74) *Attorney, Agent, or Firm* — Rossi, Kimms & McDowell LLP

(57) ABSTRACT

This invention allows completely cutting power supply to a circuit that has become dysfunctional because of blowout of a fuse. To accomplish this, a circuit includes a fuse connected to one supply line of an AC power supply, a switching unit connected to the other supply line of the AC power supply, a detection unit configured to detect blowout of the fuse, and a control unit configured to turn off the switching unit when the detection unit detects blowout of the fuse.

7 Claims, 7 Drawing Sheets

(56) References Cited

U.S. PATENT DOCUMENTS

| | | | | |
|---|---|---|---|---|
| 6,351,361 | B1 * | 2/2002 | Kawazu et al. | 361/103 |
| 6,583,977 | B1 * | 6/2003 | Oglesbee | 361/104 |
| 7,057,311 | B1 * | 6/2006 | Zhou et al. | 307/131 |
| 7,301,739 | B2 * | 11/2007 | Hamer | 361/42 |
| 7,486,494 | B1 * | 2/2009 | Chu et al. | 361/104 |
| 2004/0145337 | A1 * | 7/2004 | Morishita | 318/801 |
| 2005/0135830 | A1 * | 6/2005 | Koyama | 399/88 |
| 2005/0169659 | A1 * | 8/2005 | Koyama et al. | 399/88 |
| 2005/0280682 | A1 * | 12/2005 | Kato et al. | 347/102 |
| 2007/0047983 | A1 * | 3/2007 | Itoh et al. | 399/33 |

* cited by examiner

CIRCUIT AND HEATING APPARATUS THAT COMPLETELY CUTS POWER TO A SUPPLY CIRCUIT DUE TO BLOWOUT OF A FUSE ON A SINGLE SUPPLY LINE

BACKGROUND OF THE INVENTION

1. Field of the Invention

The present invention relates to a circuit connected to an AC power supply, and a heating apparatus using the circuit.

2. Description of the Related Art

Conventionally, a circuit which is connected to an AC power supply and cuts off an overcurrent from it using a fuse is known. In Japanese Patent Laid-Open No. 7-231659, a fuse is arranged on one of the two supply lines of a commercial AC power supply and blown out when an overcurrent flows to the supply line of the power supply. The fuse is also blown out by forcibly increasing the load current upon detecting an abnormality in the circuit.

However, even when the fuse has cut the current in only one supply line of the commercial AC power supply, as described above, an impedance that exists between the ground and the commercial power supply causes an unnecessary current to continuously flow from the other supply line without a fuse.

A typical situation will be described with reference to FIG. 7. When a fuse 4 is blown out by, for example, a short in a load circuit 11, an unwanted current Ic from a commercial AC power supply 1 continuously flows to ground 10 via a noise removing coil 7 and a noise removing capacitor 9.

SUMMARY OF THE INVENTION

The present invention allows realization of cutoff of power supply to a circuit that has become dysfunctional because of blowout of a fuse.

One aspect of the present invention provides a circuit comprising a fuse connected to one supply line of an AC power supply, a switching unit connected to the other supply line of the AC power supply and configured to open the other supply line or render the other supply line conductive and an open control unit configured to cause the switching unit to open the other supply line in accordance with blowout of the fuse.

Another aspect of the present invention provides a heating apparatus comprising a fuse connected to one supply line of an AC power supply, a heating unit configured to generate heat upon receiving power from the AC power supply via the one supply line and the other supply line, a switching circuit connected to the other supply line of the AC power supply and configured to open the other supply line or render the other supply line conductive, a capacitor provided between the other supply line and ground to be closer to the AC power supply than the heating unit and a control circuit configured to operate the switching circuit to disconnect the capacitor from the AC power supply in accordance with blowout of the fuse.

Further features of the present invention will become apparent from the following description of exemplary embodiments with reference to the attached drawings.

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Figure 5:
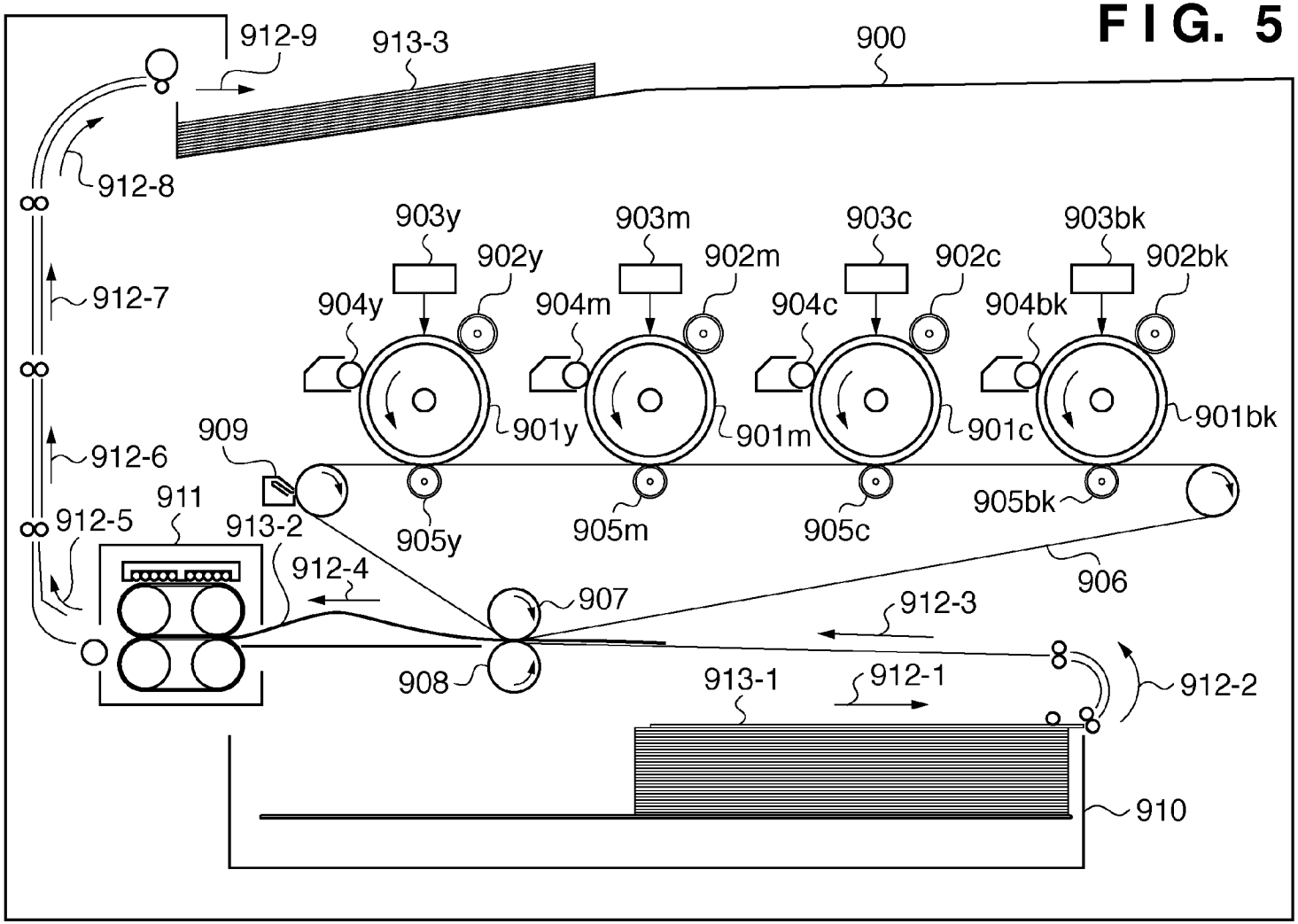
FIG. 5 is a view showing the arrangement of the image forming apparatus according to the first embodiment of the present invention.

A printer 900 according to the first embodiment of the present invention will be described with reference to FIG. 5. FIG. 5 is a schematic view showing the internal arrangement of the printer 900. In this embodiment, the printer will be described as an example of an image forming apparatus. However, the apparatus to which the present invention is applicable is not limited to this. The present invention is applicable to all apparatuses for controlling output from a power supply, including any other image forming apparatus and an information processing apparatus.

<Arrangement of Printer>

The printer 900 includes photosensitive drums 901*y*, 901*m*, 901*c*, and 901*k* (all the four photosensitive drums will be referred to as photosensitive drums 901 hereinafter). The photosensitive drum 901 rotates counterclockwise viewed from the drawing surface.

Primary charging rollers 902*y*, 902*m*, 902*c*, and 902*k* (all the four primary charging rollers will be referred to as primary charging rollers 902 hereinafter) for charging the photosensitive drums 901 are provided around them. The primary charging rollers 902 uniformly charge the surface of the photosensitive drum 901 to a negative potential. The primary charging rollers 902 superpose an AC component voltage (1,300 to 2,000 V) on a DC component voltage (−300 to −700 V) and controls a DC component current, thereby controlling the charge amount of the photosensitive drum 901. Laser units 903*y*, 903*m*, 903*c*, and 903*k* (all the four laser units will be referred to as laser units 903 hereinafter) are provided downstream of the primary charging rollers 902. The laser units 903 irradiate and expose the uniformly charged surface of the photosensitive drum 901 with a laser beam. The exposed portion lowers the impedance and decreases the charge amount. The laser units 903 draw a latent image on the surface of the photosensitive drum 901 by changing the laser beam exposure amount by PWM control.

Developing blades 904*y*, 904*m*, 904*c*, and 904*k* (all the four developing blades will be referred to as developing blades 904 hereinafter) are provided downstream of the laser units 903. The gap between the developing blades 904 and the photosensitive drum 901 is accurately managed. When a DC component voltage (−150 to −500 V) is applied to the developing blades 904, an electric field is generated between the surface of the photosensitive drum 901 and the developing blade 904. The direction and strength of the electric field affect the charge amount. On the surface of the photosensitive drum 901, an electric field from the developing blades 904 to the photosensitive drum 901 is generated at a portion which is unexposed to laser and has a large negative charge amount.

On the other hand, at a portion which is exposed to laser and has a small negative charge amount on the surface of the photosensitive drum 901, an electric field from the photosensitive drum 901 to the developing blade 904 is generated. Toner on the developing blade 904, which is charged to a negative potential, receives a force in a direction reverse to the direction of the electric field generated between the developing blade 904 and the surface of the photosensitive drum 901 and flies to the photosensitive drum 901. The toner sticks to the latent image on the photosensitive drum 901 to form a toner image.

Next, the surface of the photosensitive drum 901 comes into contact with an intermediate transfer belt 906. Primary transfer rollers 905*y*, 905*m*, 905*c*, and 905*k* (all the four primary transfer rollers will be referred to as primary transfer rollers 905 hereinafter) are provided on a side of the intermediate transfer belt 906 opposite to the photosensitive drums 901.

A voltage of +500 to +1,200 V is applied to the primary transfer roller 905 so that the toner charged to a negative potential is attracted from the photosensitive drum 901 to the primary transfer roller 905. Hence, the four color toner images on the surfaces of the photosensitive drums 901 are transferred to the surface of the intermediate transfer belt 906 while being superposed on each other.

A full color image is thus formed on the intermediate transfer belt 906 by yellow, magenta, cyan, and black toners. At a timing when the toner image on the intermediate transfer belt 906 passes between rollers 907 and 908, a sheet 913 is conveyed between the intermediate transfer belt 906 and the roller 908. At this time, a voltage of +500 to +7,000 V is applied to the roller 908 to transfer the toner image charged to a negative potential to the sheet 913. The sheet 913 is fed from a sheet cassette 910 and conveyed as indicated by arrows 912-1, 912-2, 912-3, and 912-4.

The sheet that has passed through the nip between the rollers 907 and 908 is conveyed to a fixing device 911 and receives heat and pressure so that the toner image is fixed on the sheet surface. The sheet is conveyed as indicated by arrows 912-5, 912-6, 912-7, 912-8, and 912-9 and stacked on a sheet bundle 913-3.

Figure 4:
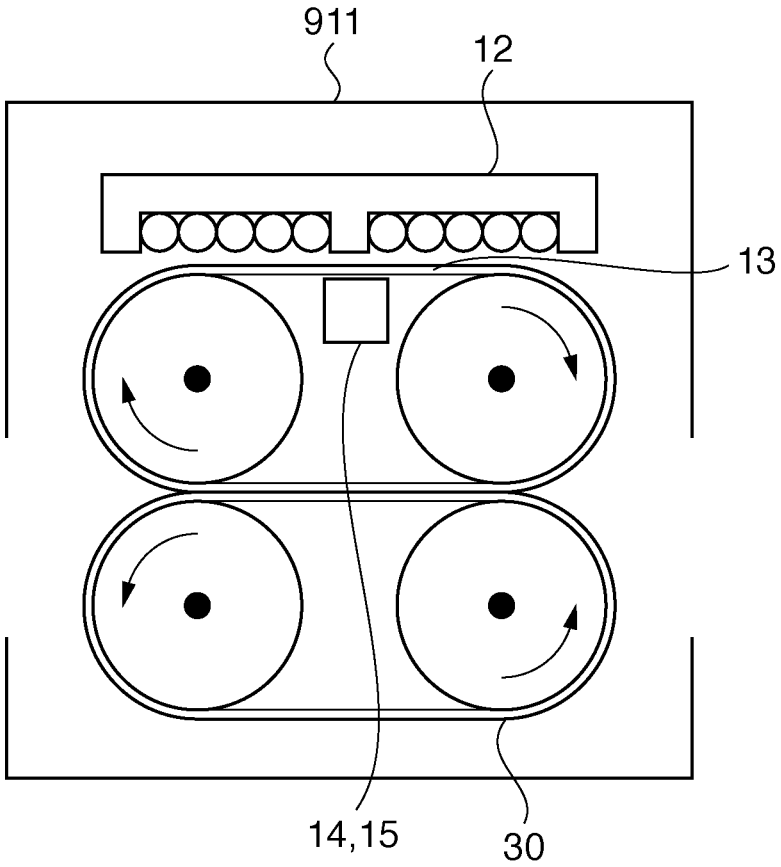
FIG. 4 is a view showing the arrangement of the fixing device of the image forming apparatus according to the first embodiment of the present invention.

FIG. 4 is an enlarged view of the fixing device 911 serving as a heating apparatus shown in FIG. 5. Referring to FIG. 4, a fixing belt 13 is made of a thermomagnetic metal and rotates in the direction of arrows by internal rollers. A pressure belt 30 drags together with the fixing belt 13. An induction heating coil 12 for heating the fixing belt 13 is provided on it. A thermoswitch 14 and thermistor 15 serving as a second detection unit are arranged on the inner surface of the fixing belt 13. The thermistor 15 can detect the temperature of the fixing belt 13. It is possible to adjust and maintain the temperature by controlling power to be supplied to the induction heating coil 12. The thermoswitch 14 is designed to be turned off at a temperature higher than 230° C. This controls the temperature to 230° C. or less even when the fixing belt 13 overheats by some failure in temperature adjustment. That is, the thermoswitch 14 functions as a detection unit which detects that the temperature of a heat target has a predetermined value or more.

<Circuit Arrangement>

Figure 1:
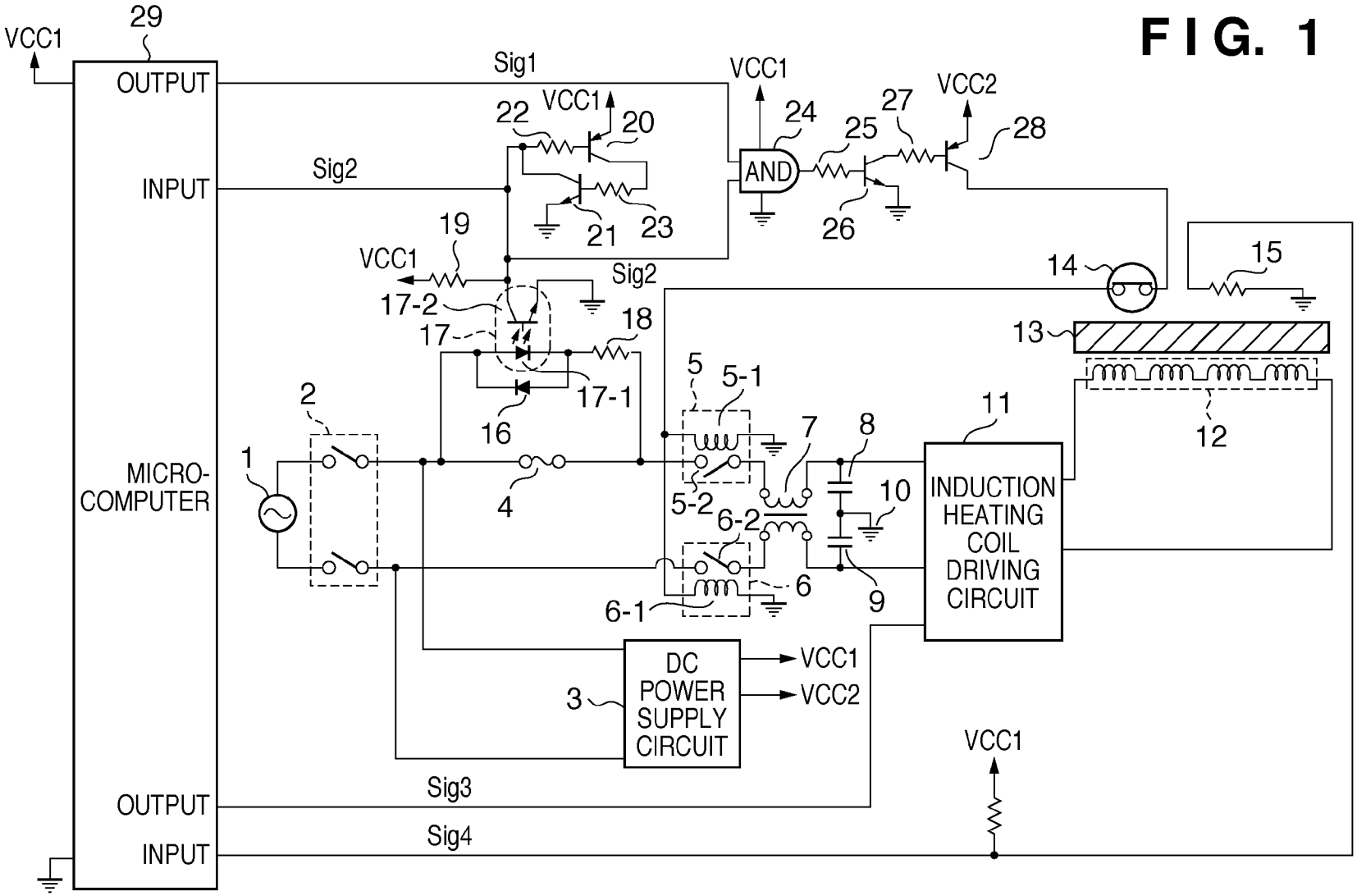
FIG. 1 is a circuit diagram showing a circuit arrangement according to the first embodiment of the present invention.

FIG. 1 shows the detailed arrangement of a circuit including the fixing belt 13, induction heating coil 12, thermoswitch 14, and thermistor 15. An induction heating coil driving circuit 11 drives the induction heating coil 12. The thermistor 15 which has detected the inner surface temperature of the fixing belt 13 inputs an output signal Sig4 to a microcomputer 29. Based on the detected temperature, the microcomputer 29 outputs a signal Sig3 to drive the induction heating coil driving circuit 11 and adjust the temperature of the fixing belt 13. In this embodiment, the target temperature of the fixing belt 13 is 180° C. The thermoswitch 14 is designed to be turned off if its temperature exceeds 230° C. A commercial AC power supply 1 has an AC voltage of 100 V and a frequency of 50 Hz. AC power from the AC power supply 1 is supplied to the induction heating coil 12 via the driving circuit 11. A switch 2 is used by the user to manually turn on/off the commercial AC power supply 1. A DC power supply circuit 3 receives the voltage from the commercial AC power supply 1 and outputs two DC power supply voltages VCC1 and VCC2.

The voltage VCC1 is 3.3 V, and the voltage VCC2 is 12 V. A fuse 4 is blown out when a current more than, for example, 15 A flows. Relays 5 and 6 serve as switching units which open the supply lines of the power supply 1 or render them conductive. When a current flows to relay coil portions 5-1 and 6-1, relay switch portions 5-2 and 6-2 are turned on to render the supply lines conductive. On the other hand, when no current flows to the relay coil portions 5-1 and 6-1, the relay switch portions 5-2 and 6-2 are turned off to open the supply lines. That is, the fuse 4 and relay 5 are connected to one supply line of the commercial AC power supply 1. No fuse but the relay 6 is connected to the other supply line.

More specifically, when the thermoswitch 14 is conductive and a transistor 28 is ON, a current flows from VCC2 to the ground via the transistor 28, thermoswitch 14, and relay coil portions 5-1 and 6-1 so that the relay switch portions 5-2 and 6-2 are turned on. Reference numeral 7 denotes a noise removing coil; and 8 and 9, noise removing capacitors inserted between the ground and the two supply lines of the commercial AC power supply. Each of the noise removing capacitors 8 and 9 is generally called a Y capacitor.

A phototransistor coupler 17 is connected between the two terminals of the fuse 4. Reference numeral 16 denotes a diode for protecting the phototransistor coupler 17. When the switch 2 is ON, the relays 5 and 6 are ON, and the fuse 4 is not blown out, the voltage across the fuse 4 is almost 0 V. However, when the fuse 4 is blown out, the voltage of the commercial power supply is applied across it. A current limited by a resistor 18 flows to an LED portion 17-1 of the phototransistor coupler 17 to turn on a transistor portion 17-2. That is, the phototransistor coupler 17 and resistor 18 function as a detection unit which detects the voltage across the fuse 4. A signal Sig2 changes to Low level, and the output from an AND circuit 24 changes to Low level to turn off transistors 26 and 28. Then, the relays 5 and 6 are turned off independently of a signal Sig1 output from the microcomputer 29. That is, the phototransistor coupler 17, AND circuit 24, transistors 26 and 28 and the like function as a device which turns off the relays 5 and 6.

The relays 5 and 6 that are turned off completely cut the current path from the commercial AC power supply 1 to the noise removing coil 7, noise removing capacitors 8 and 9, and induction heating coil driving circuit 11. Hence, no wasteful current flows at all. No current flows to the LED portion 17-1 of the phototransistor coupler 17, either. When the signal Sig2 is High, the signal Sig1 ON/OFF-controls the relays 5 and 6.

However, if the temperature of the fixing belt 13 exceeds 230° C. to turn off the thermoswitch 14, the relays 5 and 6 are turned off independently of the signals Sig1 and Sig2, and power supply to the coil driving circuit 11 stops. Once the signal Sig2 changes to Low level, transistors 20 and 21 latch it to maintain Low level until the switch 2 turns off/on the power supply. For this reason, the relays 5 and 6 which are turned off to stop the current to the LED portion 17-1 of the phototransistor coupler 17 are never turned on again. Reference numerals 22, 23, 25, and 27 denote base resistances of the transistors 20, 21, 26, and 28, respectively. The collector of the transistor portion 17-2 of the phototransistor coupler 17 is connected to VCC1 via a resistor 19. When the transistor portion 17-2 is OFF, the signal Sig2 has High level. The signal Sig2 is also connected to an input terminal of the microcomputer 29. Hence, the microcomputer 29 can detect the states of the fuse 4 and the relays 5 and 6.

Figure 2:
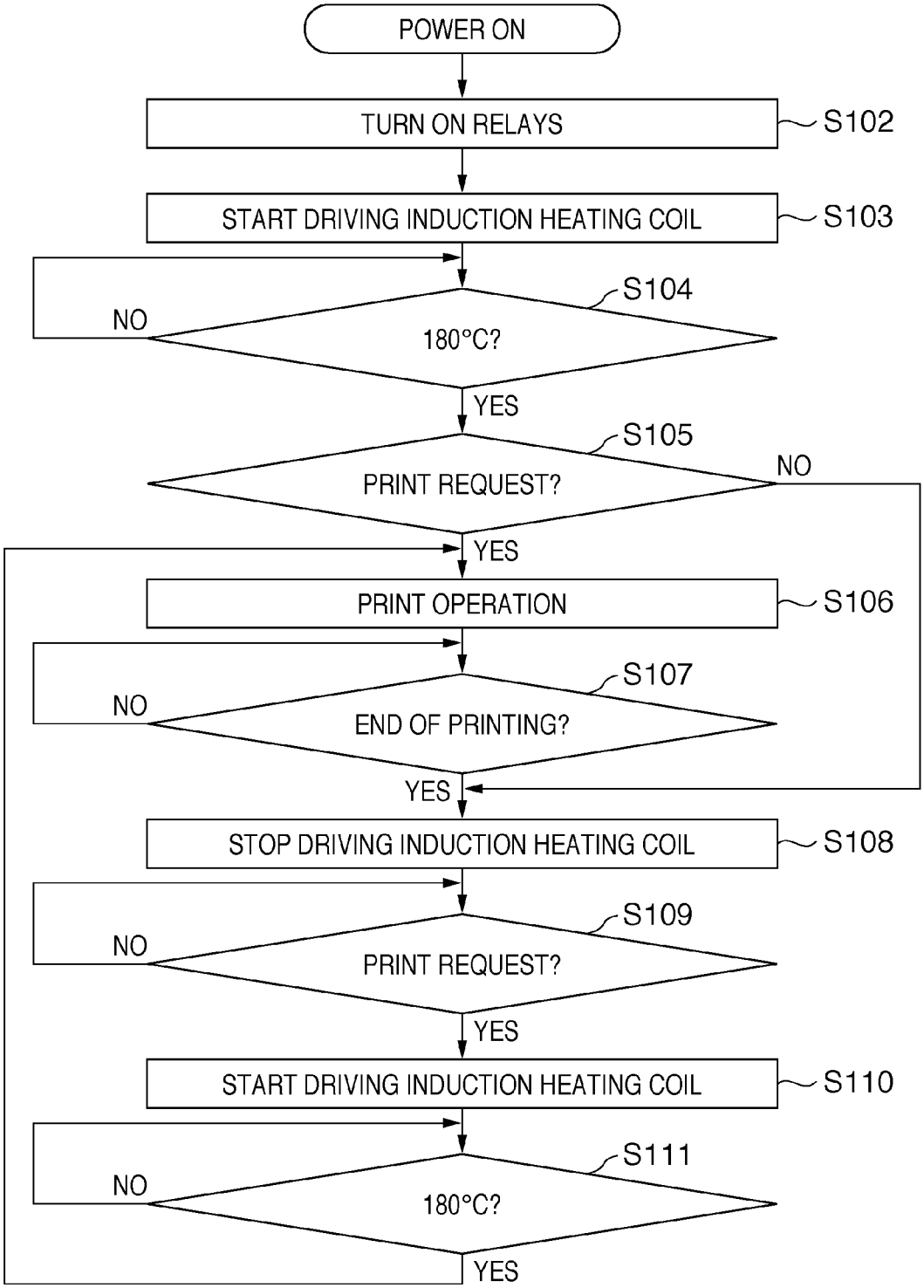
FIG. 2 is a flowchart illustrating the sequence of a process performed in an image forming apparatus according to the first embodiment of the present invention.

The control sequence of the microcomputer 29 will be described next with reference to FIG. 2. Upon powering on, the microcomputer 29 sets the signal Sig1 at High level to turn on the relays 5 and 6 (S102) and start driving the induction heating coil 12 (S103). Upon detecting that the temperature detected by the thermistor 15 has reached the target temperature of 180° C. (S104), the microcomputer 29 determines whether a print request is received from a printer controller (not shown) (S105). Upon receiving a print request, the process advances to step S106. The microcomputer 29 performs the print operation, waits for the end of printing (S107), and stops driving the induction heating coil (S108). The microcomputer 29 then determines the presence/absence of a print request (S109), and upon receiving a print request, starts driving the induction heating coil (S110). The microcomputer 29 determines whether the temperature detected by the thermistor 15 has reached 180° C. (S111), repeats the process from step S106 described above once 180° C. is reached. If no print request is received in step S105, the microcomputer 29 executes the process from step S108.

Figure 3:
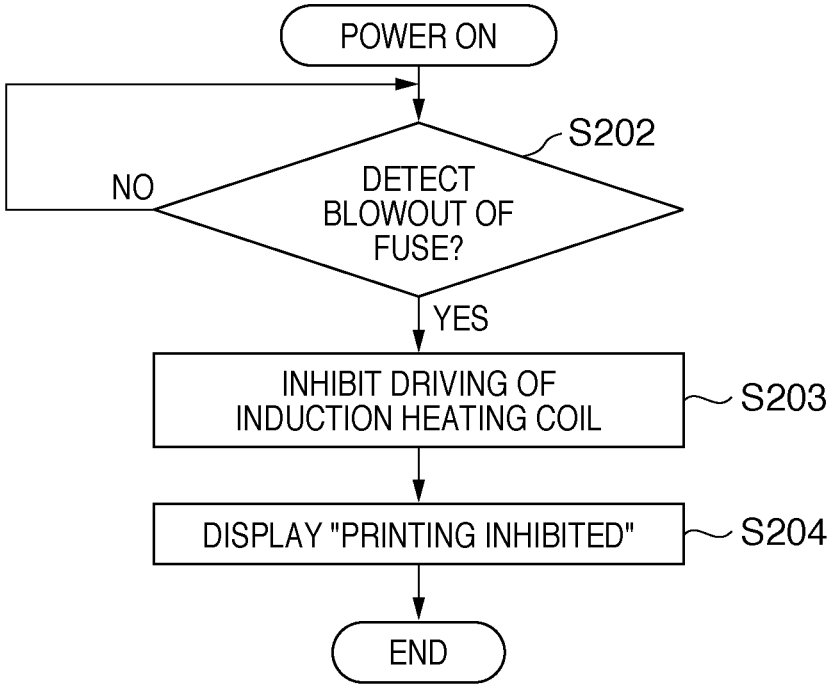
FIG. 3 is a flowchart illustrating the sequence of a process performed in the image forming apparatus according to the first embodiment of the present invention.

The control sequence shown in FIG. 3 is also executed in parallel. Upon powering on, the microcomputer 29 detects based on the signal Sig2 whether the fuse 4 is blown out (S202). If the fuse is blown out, the microcomputer 29 sets the signals Sig1 and Sig3 at Low level to inhibit driving of the induction heating coil 12 (S203). The microcomputer 29 also displays, on a display unit (not shown), a message representing that printing is inhibited (S204). That is, the microcomputer 29 also functions as a device that turns off the relays 5 and 6.

If the fuse 4 is blown out in the circuit arrangement including the fuse 4 and the Y capacitors 8 and 9 in this order from the commercial power supply 1 to the downstream side, only the Y capacitor 9 on the line opposite to that of the fuse 4 which has been blown out is kept connected, and a current flows. This current is wasteful. To prevent the wasteful current from flowing, the microcomputer 29 detects that the fuse 4 has been blown out and disconnects the Y capacitors 8 and 9 from the commercial power supply 1 by the relays 5 and 6.

As described above, according to this embodiment, it is possible to cut power supply to a circuit that has become dysfunctional because of blowout of a fuse and save energy.

Second Embodiment

Figure 6:
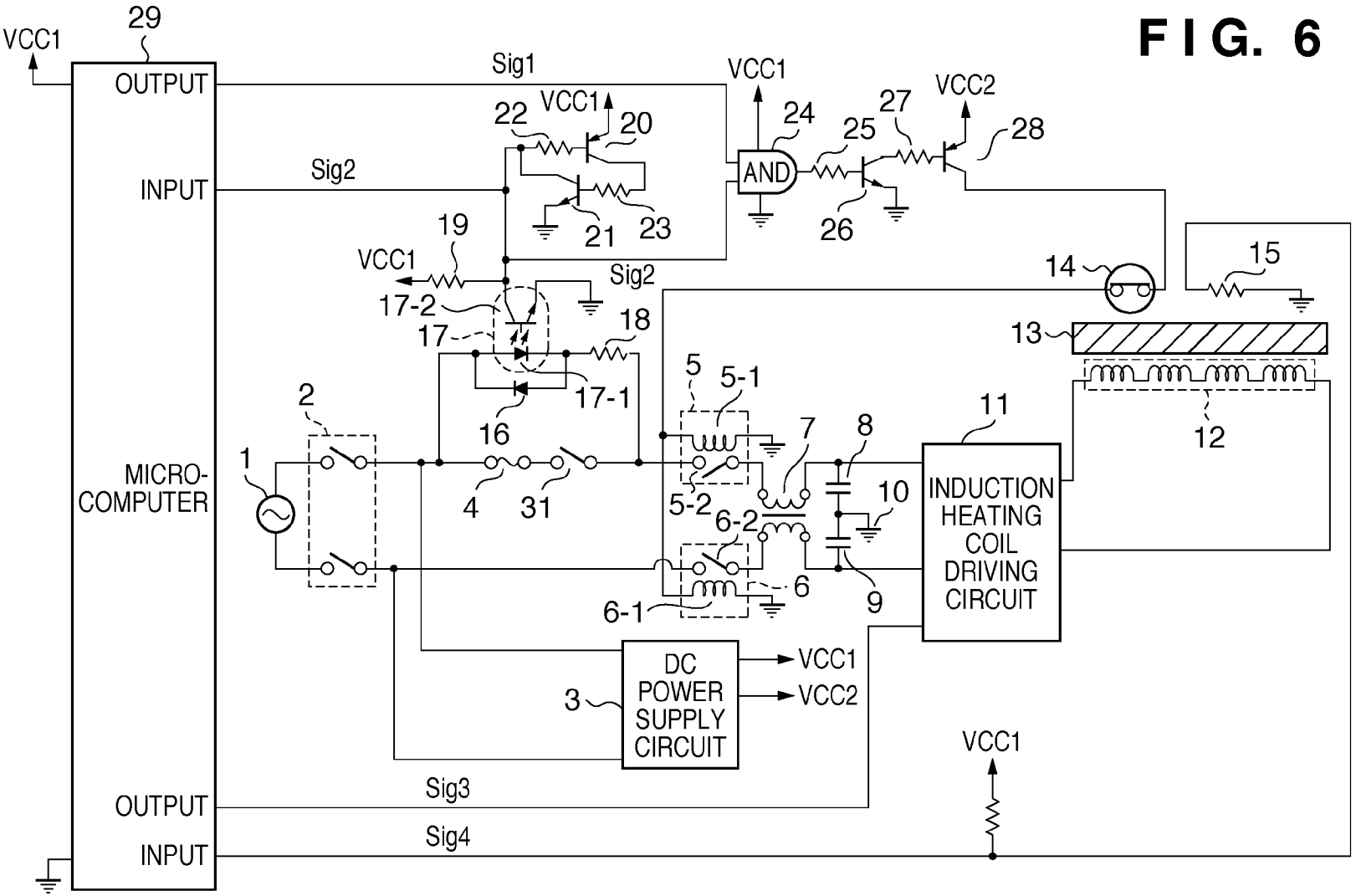
FIG. 6 is a circuit diagram showing a circuit arrangement according to the second embodiment of the present invention.
Figure 7:
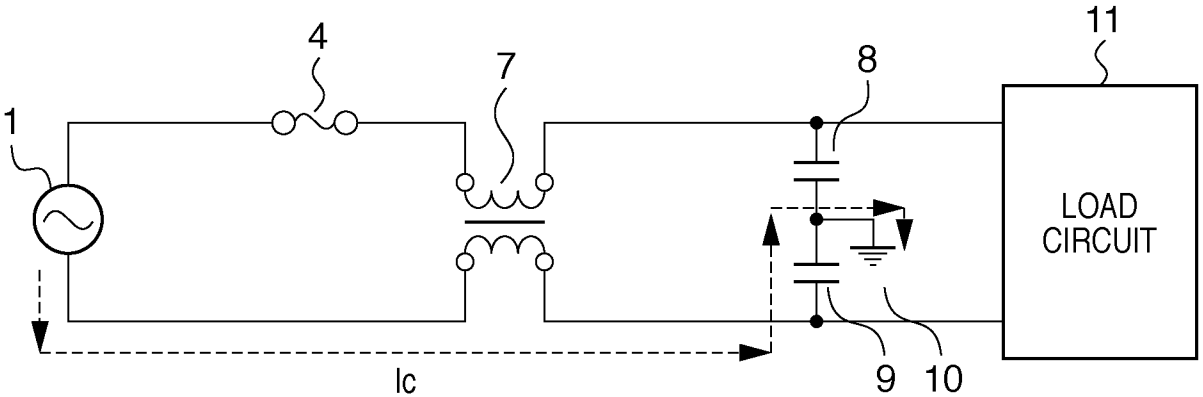
FIG. 7 is a circuit diagram showing the circuit arrangement of a prior art.

The second embodiment of the present invention will be described with reference to FIG. 6. Unlike the first embodiment shown in FIG. 1, a switch 31 is connected in series with the fuse 4. When an inspector or inspection device turns off the switch 31, relays 5 and 6 are turned off as in blowout of the fuse 4. It is therefore possible to inspect the circuit without turning off the relays 5 and 6 because of a failure at part of the circuit upon blowing out the fuse 4.

As described above, when the fuse is blown out, no wasteful current flows to the circuit that has become dysfunctional. In addition, the reliability can be increased by inspecting the function.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-199895 filed on Jul. 31, 2007, which is hereby incorporated by reference herein in its entirety.

What is claimed is:

1. An image forming apparatus comprising:

an image forming unit configured to form a toner image on a sheet;

a fixing unit configured to fix the toner image formed on the sheet;

first and second lines configured to serve as a pair of supply lines for supplying power from an AC power supply to said fixing unit;

a fuse provided on the first line and configured to be blown when a current of more than a predetermined value passes through the fuse;

a first switch provided on the second line and configured to open the second line or render the second line conductive;

a temperature detection unit configured to, if a temperature of the fixing unit exceeds a predetermined temperature, cause said first switch to open the second line; and an open control unit configured to cause said first switch to open the second line in accordance with blowout of said fuse independently of an operation of said temperature detection unit.

2. The image forming apparatus according to claim 1, wherein said open control unit includes:

a blowout signal generation circuit configured to generate a blowout signal according to blowout of said fuse; and an open signal generation circuit configured to output, to said first switch, an open signal to cause said first switch to open the second line in accordance with the blowout signal.

3. The image forming apparatus according to claim 2, wherein said blowout signal generation circuit generates the blowout signal when a voltage across said fuse reaches a predetermined voltage.

4. The image forming apparatus according to claim 1, further comprising:

a second switch connected in series with said fuse and configured to open the first line, wherein said temperature detection unit causes said second switch to open the first line if the temperature of the fixing unit exceeds the predetermined temperature.

5. The image forming apparatus according to claim 1, further comprising:

a capacitor provided between the second line and ground on a downstream side of said fuse with respect to the AC power supply, wherein said first switch disconnects said capacitor from the AC power supply.

6. The image forming apparatus according to claim 4, wherein said open control unit causes said second switch to open the first line in accordance with blowout of said fuse.

7. The image forming apparatus according to claim 1, wherein the temperature detection unit is a thermoswitch configured to be turned off if the temperature of the fixing unit exceeds the predetermined temperature.

* * * * *